US010766664B2

(12) United States Patent
Leo Ramirez

(10) Patent No.: US 10,766,664 B2
(45) Date of Patent: Sep. 8, 2020

(54) MODULAR POTTED PLANT SHIPPING BOX

(71) Applicant: Flowered & Company, LLC, Aventura, FL (US)

(72) Inventor: Alberto Leo Ramirez, Aventura, FL (US)

(73) Assignee: Flowered & Company, LLC, Aventura, FL (US)

( * ) Notice: Subject to any disclaimer, the term of this patent is extended or adjusted under 35 U.S.C. 154(b) by 100 days.

(21) Appl. No.: 16/239,169

(22) Filed: Jan. 3, 2019

(65) Prior Publication Data

US 2020/0216215 A1 Jul. 9, 2020

(51) Int. Cl.
*B65D 85/50* (2006.01)
*B65D 5/50* (2006.01)
*B65D 85/52* (2006.01)

(52) U.S. Cl.
CPC ..... *B65D 5/5045* (2013.01); *B65D 85/52* (2013.01)

(58) Field of Classification Search
CPC ..... B65D 5/02; B65D 5/5045; B65D 77/04; B65D 85/52
USPC ..... 206/423, 591–594; 47/41.01, 41.11, 84
See application file for complete search history.

(56) References Cited

U.S. PATENT DOCUMENTS 3,342,329 A * 9/1967 Knight ..... B65D 77/042 206/423
4,941,572 A * 7/1990 Harris ..... B65D 85/505 206/204
2003/0145520 A1* 8/2003 Bazzani ..... B65D 81/18 47/84
2003/0160092 A1* 8/2003 Philips ..... B65D 5/5045 229/122.32
2003/0168369 A1* 9/2003 Kroeze ..... B65D 5/5028 206/423
2009/0114560 A1* 5/2009 Harshman ..... B65D 85/505 206/423
2013/0125361 A1* 5/2013 Ullrich ..... B65D 5/48 29/401.1
2014/0048435 A1* 2/2014 Ullrich ..... B65D 85/52 206/423
2017/0291758 A1* 10/2017 Muzzall ..... B65D 5/5007

* cited by examiner

*Primary Examiner* — Luan K Bui

(57) ABSTRACT

A modular potted plant shipping box is an apparatus that protects a potted plant throughout a shipment process while preserving the structure of the plant. The apparatus includes an outer box, a stopper frame, a stabilizing frame, and a receptacle. The outer box contains and protects the stopper frame, the stabilizing frame, the receptacle, and a plant housed within the receptacle. The stopper frame maintains a desired position of the stabilizing frame, and consequently the receptacle, within the outer box. The stabilizing frame maintains the desired position of the receptacle within the outer box. The receptacle houses the plant. The apparatus may further include a removable compartment that houses a variety of items that may compliment the plant housed by the receptacle. The receptacle is positioned within the stabilizing frame, and the stopper frame is positioned in between the stabilizing frame and a main opening of the outer box.

18 Claims, 6 Drawing Sheets

MODULAR POTTED PLANT SHIPPING BOX

FIELD OF THE INVENTION

The present invention relates generally to shipping boxes. More specifically, the present invention is a modular potted plant shipping box that preserves the structure and integrity of a potted plant.

BACKGROUND OF THE INVENTION

The flower industry is a forever growing industry that greatly depends on shipping. Many variables dictate whether the delivery of flowers is a success. Such variables include, the amount of time between arrangement and delivery, the insulation that maintains a desired temperature within the shipment container, and so on. Ensuring that the plant itself, however, is preserved and not damaged throughout transportation is a variable that may be consistent for all shipments.

The present invention ensures the plants, preferably flowers, to be effectively protected throughout a shipment process while minimizing the amount packing material required to protect the plant. The present invention accommodates a variety of pots and vases and varying plants. The present invention minimizes the manufacturing cost of packing material needed to effectively contain and protect a potted plant. The present invention also allows additional items to be included with the package without compromising the safety of the potted plant.

DETAILED DESCRIPTION OF THE INVENTION

Figure 1:
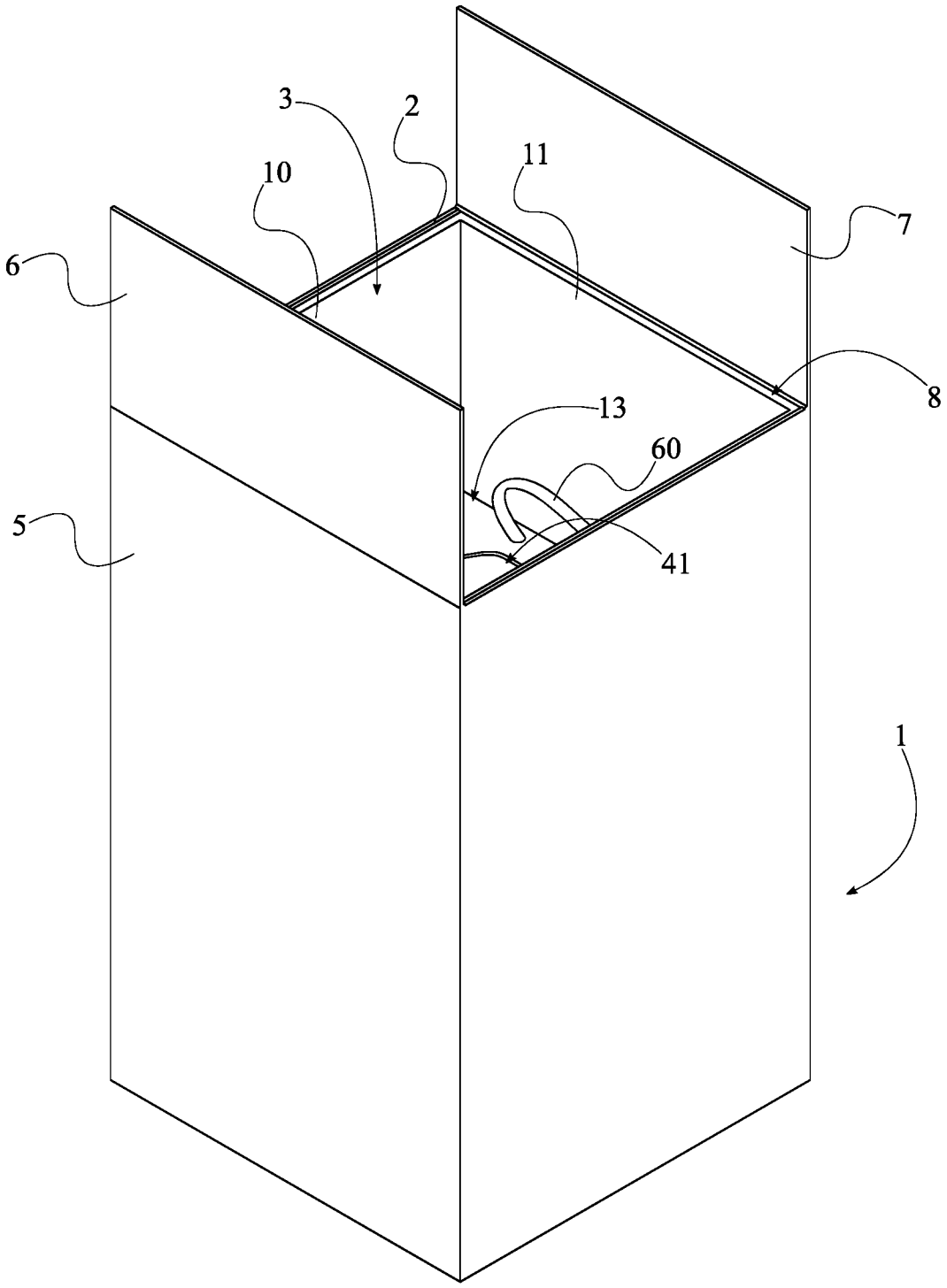
FIG. 1 is a top perspective view of the present invention.

All illustrations of the drawings are for the purpose of describing selected versions of the present invention and are not intended to limit the scope of the present invention.

The present invention is a modular potted plant shipping box that securely positions a potted plant within a shipping box. More specifically, the present invention prevents a vase or a pot from sliding and moving within the shipping box without damaging the plant. The present invention preserves the integrity and structure of the plant. The present invention accommodates a variety of potted plants. In order for the present invention to maintain a desired position of a potted plant within a shipping box, the present invention comprises an outer box 1, a stopper frame 8, a stabilizing frame 13, and a receptacle 41. The outer box 1 protects and houses the stopper frame 8, the stabilizing frame 13, the receptacle 41, and a plant within the receptacle 41, seen in FIG. 1, FIG. 2, and FIG. 6. The stopper frame 8 prevents the stabilizing frame 13 from sliding within the outer box 1, and the stabilizing frame 13 maintains the desired position of the receptacle 41 within the outer box 1. Moreover, the stopper frame 8 also allows a plant to remain erect within the outer box 1 while holding the position of the stabilizing frame 13. The receptacle 41 houses a plant and the soil. In order for the stabilizing frame 13 to secure the receptacle 41 within the outer box 1 and allow a plant to freely extend past the receptacle 41, the stabilizing frame 13 comprises a main base plate 14, a first brace 17, a second brace 28, and a central slot 37. The main base plate 14 connects the first brace 17 to the second brace 28. The first brace 17 and the second brace 28 surround and press against the receptacle 41. The central slot 37 allows the receptacle 41 to be positioned within the stabilizing frame 13.

In the preferred embodiment of the present invention, the outer box 1, the stopper frame 8, and the stabilizing frame 13 comprise cardboard materials. It is understood, various embodiments of the present invention may comprise a variety of comparable shipping materials. In alternate embodiments of the present invention, the plants housed within the receptacle 41 are natural flowers, but not necessarily fresh flower. The plants are also preferably fixed within the vase so that the plants do not escape the receptacle 41 and move within the outer box 1. The receptacle 41 is preferably a vase, shown in FIG. 3, FIG. 4, FIG. 5, and FIG. 6. with foam manufactured to fit within the vase. Additional wires and nets may further secure the foam within the vase.

Figure 6:
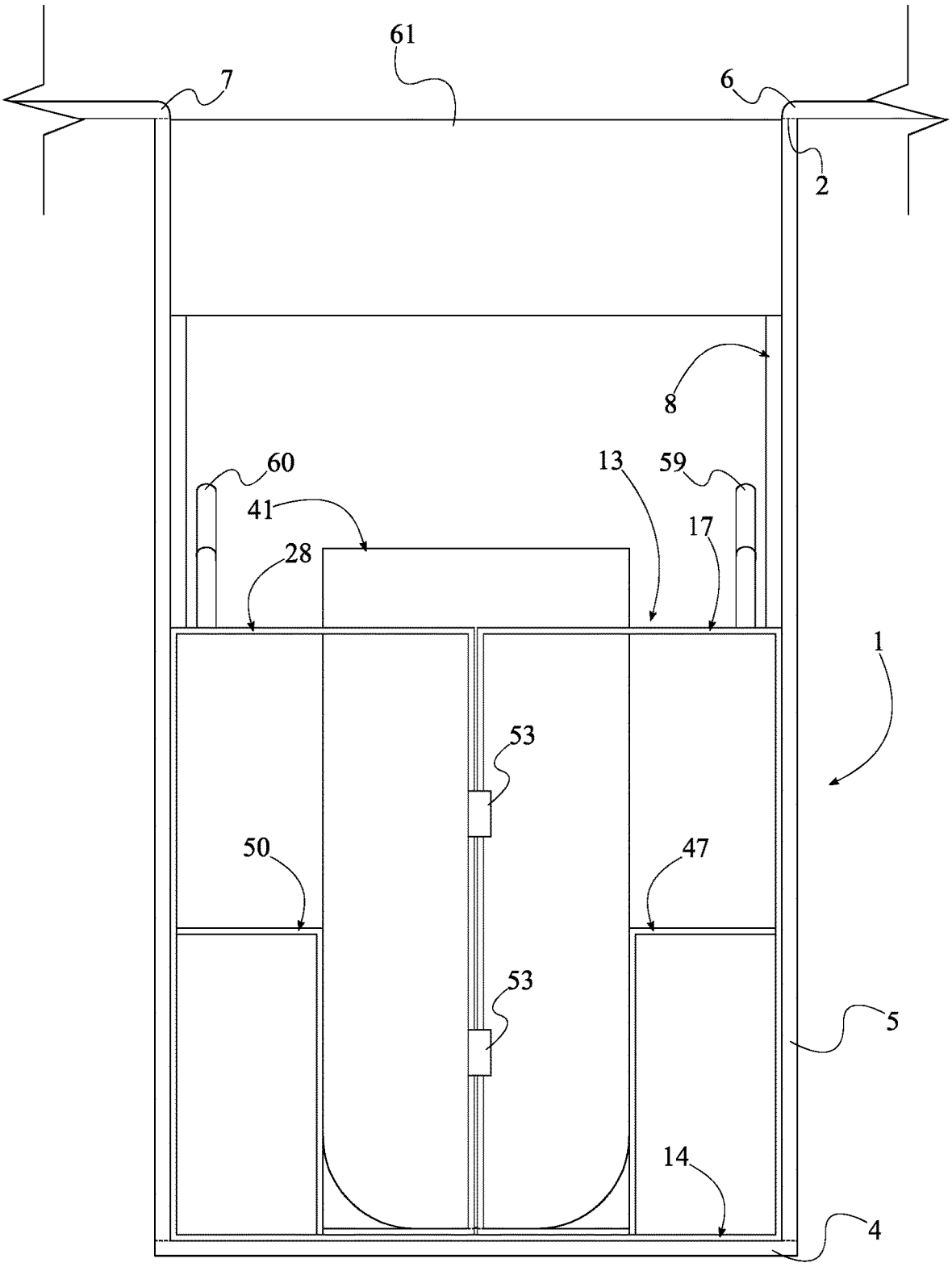
FIG. 6 is a schematic view of an alternate embodiment of the present invention with a removable compartment suspended by the stopper frame within the outer box.

The overall configuration of the aforementioned components allows a potted plant to be safely and securely contained within a shipping box. As shown in FIG. 1, and FIG. 6, the stabilizing frame 13, the stopper frame 8, and the receptacle 41 are positioned within the outer box 1. Seen in FIG. 2 and FIG. 3, a first edge 15 of the main base plate 14 is positioned opposite a second edge 16 of the main base plate 14, across the main base plate 14. The receptacle 41 is easily separated from the stabilizing frame 13 as the first brace 17 is hingedly connected to the main base plate 14 along the first edge 15 of the main base plate 14. Similarly, the second brace 28 is hingedly connected to the main base plate 14 along the second edge 16 of the main base plate 14. The receptacle 41 is securely contained as the central slot 37 traverses through the first brace 17 and the second brace 28. The weight of the receptacle 41 and the plant housed within the receptacle 41 is balanced by the main base plate 14 as the central slot 37 is oriented perpendicular with the main plate 14. Moreover, the receptacle 41 is positioned within the central slot 37, between the first brace 17 and the second brace 28 and is frictionally engaged with a main rim 38 of the central slot 37. The stabilizing frame 13, the stopper frame 8, and the receptacle 41 are housed by the outer box 1 as a fourth rim 2 of the outer box 1 is positioned opposite a base 4 of the outer box 1 across a lateral wall 5 of the outer box 1. More specifically, a main opening 3 of the outer box 1 is defined by the fourth rim 2. The stabilizing frame 13 is pressed against the base 4 of the outer box 1 and the plant freely extends past the receptacle 41 as the stopper frame 8 is positioned in between the stabilizing frame 13 and the fourth rim 2.

Figure 2:
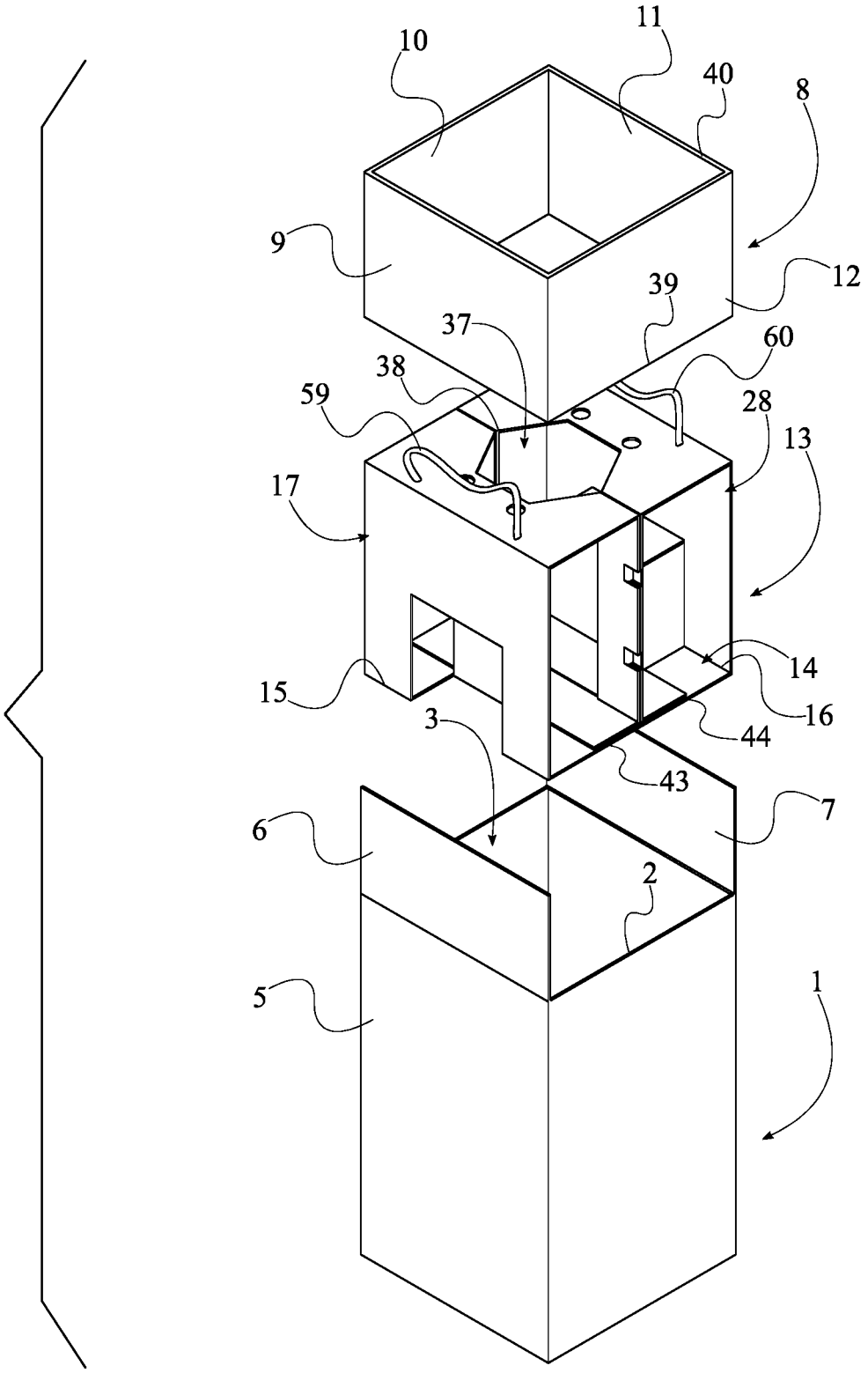
FIG. 2 is an exploded view of an outer box, a stopper frame, and a stabilizing frame of the present invention.

In the preferred embodiment of the present invention, the stabilizing frame 13 is offset from the main opening 3 of the outer box 1 with only the stopper frame 8, as seen in FIG. 1 and FIG. 2. A second rim 39 of the stopper frame 8 is positioned opposite a third rim 40 of the stopper frame 8, across the stabilizing frame 13. The second rim 39 is positioned adjacent the main rim 38 of the central slot 37. The third rim 40 is positioned adjacent the fourth rim 2 of the outer box 1. A first rim 42 of the receptacle 41 is oriented parallel with the second rim 39, the third rim 40, and the fourth rim 2. This arrangement allows a plant to extend past the first rim 42 of the receptacle 41 and remain undamaged through transportation.

The receptacle 41 is effectively contained while being readily removable from stabilizing frame 13. Furthermore, the corresponding plant remains untouched as the first brace 17 comprises a first lateral wall 18, a first cover plate 20, a first stabilizing arm 22, and a second stabilizing arm 23, shown in FIG. 3, FIG. 4, and FIG. 5. The first lateral wall 18 presses against the outer box 1 so that the receptacle 41 does not topple. The first lateral wall 18 also connects the first cover plate 20 with the main base plate 14. The first cover plate 20 prevents the receptacle 41 from slipping past the stabilizing frame 13 and into the stopper frame 8. The first stabilizing arm 22 and the second stabilizing arm 23 preserves the upright orientation of the receptacle 41 and prevents the receptacle 41 from slipping side to side. The receptacle 41 is easily separated from the stabilizing frame 13 as the first lateral wall 18 is hingedly connected along the first edge 15 of the main base plate 14. The first cover plate 20 is positioned adjacent along a first edge 19 of the first lateral wall 18, opposite the main base plate 14, and is hingedly connected along the first edge 19 of the first lateral wall 18. This arrangement allows the receptacle 41 to be easily positioned within the central slot 37 while preserving the structure of the plant. The first stabilizing arm 22 and the second stabilizing arm 23 is positioned adjacent a first edge 21 of the first cover plate 20 opposite the first lateral wall 18, thereby leveling the first cover plate 20 with the first stabilizing arm 22 and the second stabilizing arm 23. The receptacle 41 does not slide within the central slot 37 as the first stabilizing arm 22 is positioned opposite the second stabilizing arm 23 across the first edge 21 of the first cover plate 20. Moreover, the receptacle 41 is positioned between and is frictionally engaged with the first stabilizing arm 22 and the second stabilizing arm 23. The stopper frame 8 is securely upheld by the stabilizing frame 13 as the first cover plate 20 is offset from the main base plate 14 with the first lateral wall 18, the first stabilizing arm 22, and the second stabilizing arm 23. In order for the receptacle 41 to be safely removed from within the outer box 1, the receptacle 41 must be surrounded by the stabilizing frame 13 while being removed from the outer box 1. The first stabilizing arm 22 and the second stabilizing arm 23 are removably coupled to the second brace 28, maintaining the grip of the stabilizing frame 13 about the receptacle 41.

Figure 3:
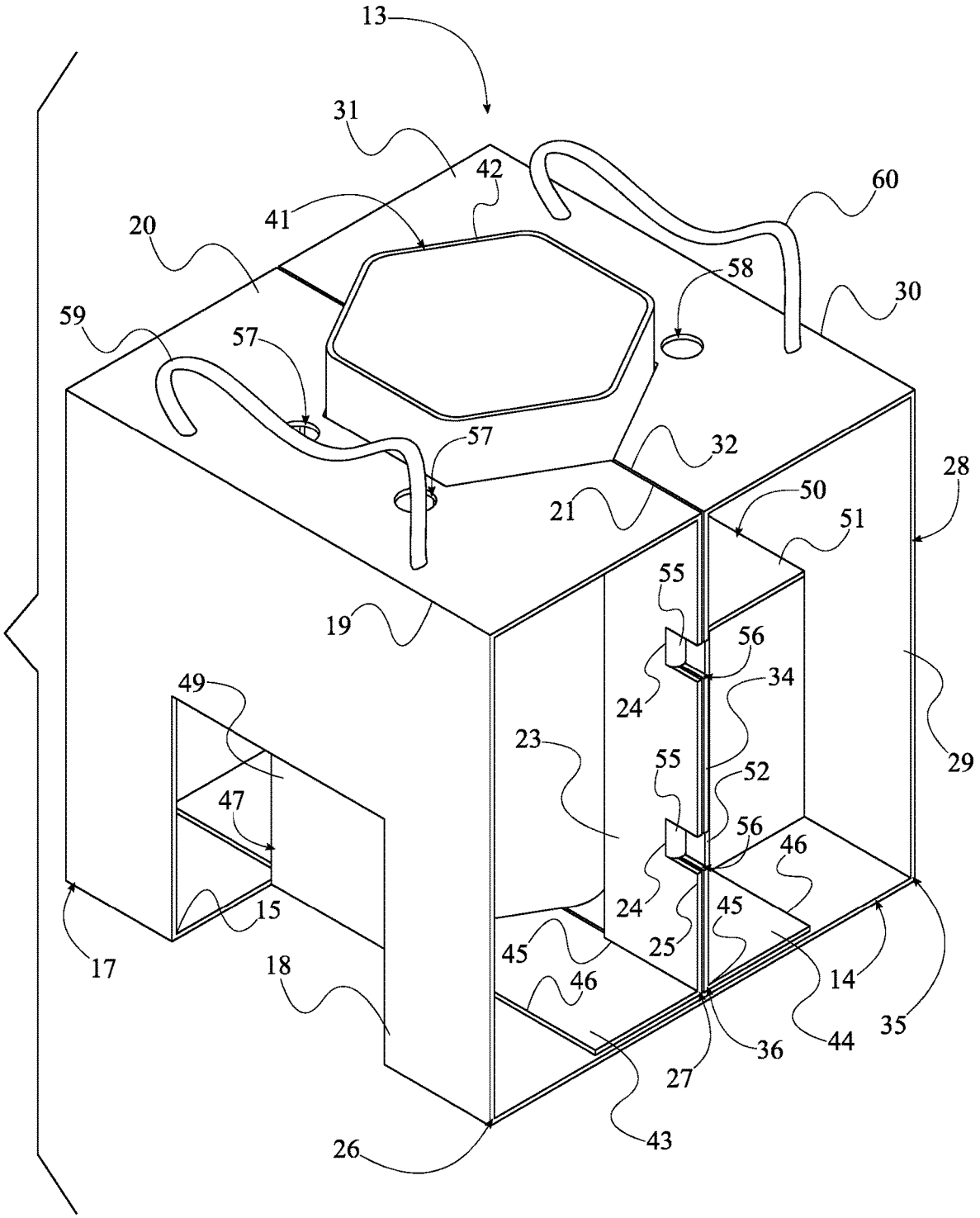
FIG. 3 is a perspective view a receptacle and the stabilizing frame of the present invention with at least one first push tab engaged with at least one first tab-receiving slot.
Figure 4:
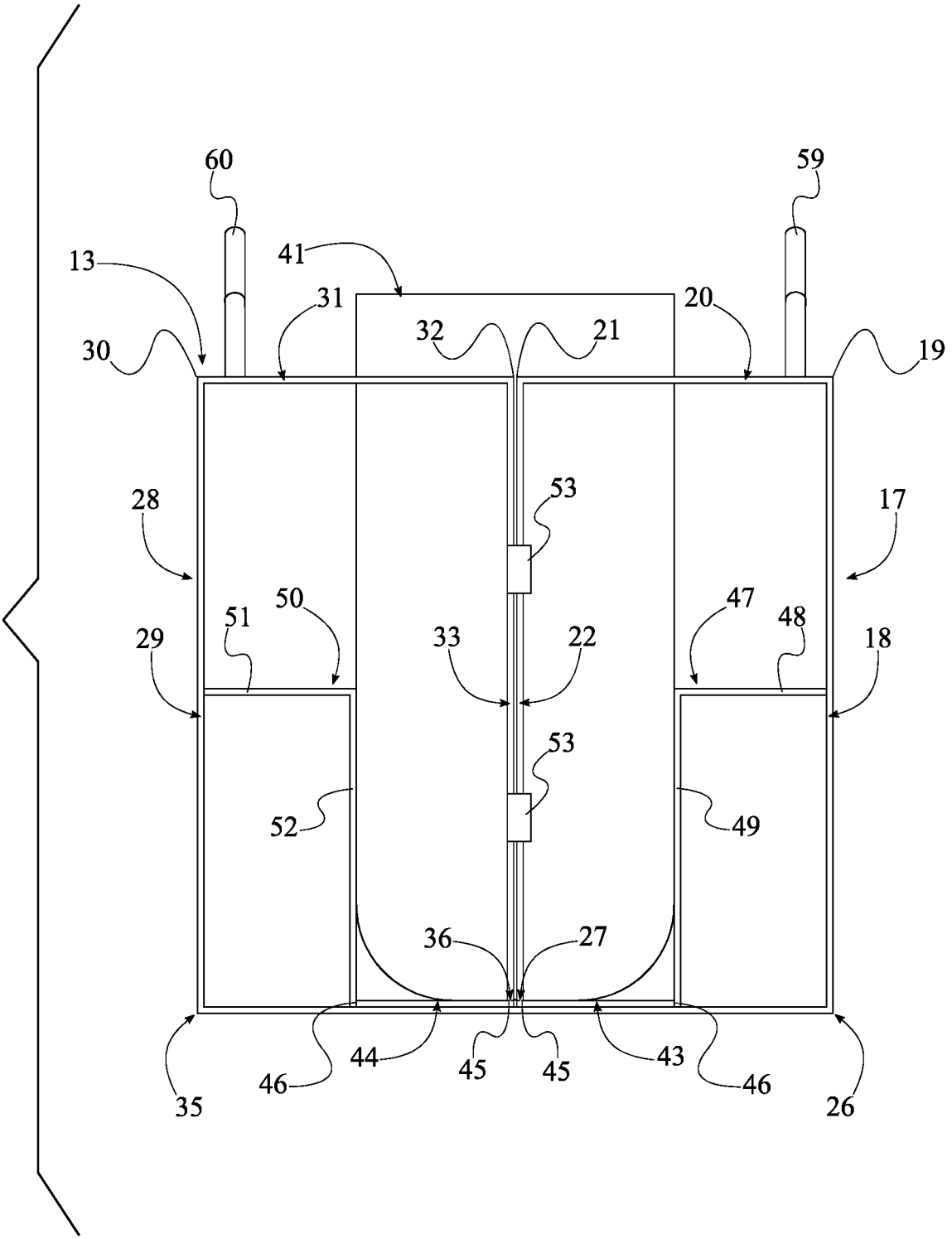
FIG. 4 is a side view the receptacle and the stabilizing frame of the present invention with at least one first push tab engaged with at least one first tab-receiving slot.
Figure 5:
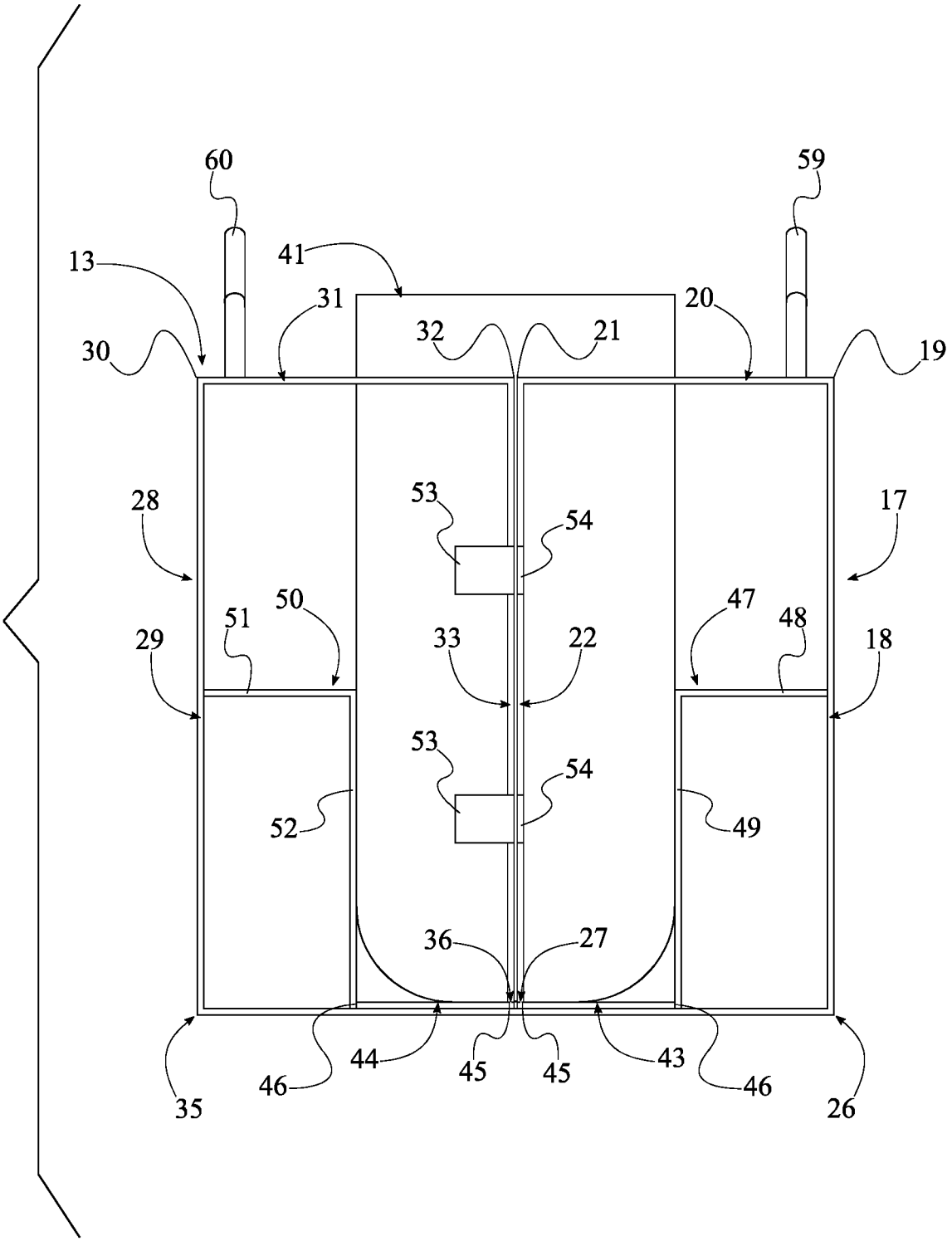
FIG. 5 is a side view of the present invention with at least one first push tab disengaged with at least one first tab-receiving slot.

Similar to the first brace 17, the second brace 28 comprises a second lateral wall 29, a second cover plate 31, a third stabilizing arm 33, and a fourth stabilizing arm 34, shown in FIG. 3, FIG. 4, and FIG. 5. The second lateral wall 29 presses against the outer box 1 so that the receptacle 41 does not topple. The second lateral wall 29 also connects the second cover plate 31 with the main base plate 14. The second cover plate 31 prevents the receptacle 41 from slipping past the stabilizing frame 13 and into the stopper frame 8. The third stabilizing arm 33 and the fourth stabilizing arm 34 preserves the upright orientation of the receptacle 41 and prevents the receptacle 41 from slipping side to side. The receptacle 41 is easily separated from the stabilizing frame 13 as the second lateral wall 29 is hingedly connected along the second edge 16 of the main base plate 14. The second cover plate 31 is positioned adjacent along a first edge 30 of the second lateral wall 29, opposite the main base plate 14, and is hingedly connected along the first edge 30 of the second lateral wall 29. This arrangement allows the receptacle 41 to be easily positioned within the central slot 37 while preserving the structure of the plant. The second cover plate 31 is leveled with the third stabilizing arm 33 and the fourth stabilizing arm 34 as the third stabilizing arm 33 and the fourth stabilizing arm 34 is positioned adjacent a first edge 32 of the second cover plate 31 opposite the second lateral wall 29. The receptacle 41 does not slide within the central slot 37 as the third stabilizing arm 33 is positioned opposite the fourth stabilizing arm 34 across the first edge 32 of the second cover plate 31. Moreover, the receptacle 41 is positioned between and is frictionally engaged with the third stabilizing arm 33 and the fourth stabilizing arm 34. The stopper frame 8 is securely upheld by the stabilizing frame 13 as the second cover plate 31 is offset from the main base plate 14 with the second lateral wall 29, the third stabilizing arm 33, and the fourth stabilizing arm 34. In order for the receptacle 41 to be safely removed from within the outer box 1, the receptacle 41 must be surrounded by the stabilizing frame 13 while being removed from the outer box 1. The third stabilizing arm 33 and the fourth stabilizing arm 34 are removably coupled to the first brace 17, maintaining the grip of the stabilizing frame 13 about the receptacle 41.

The first brace 17 does not buckle throughout transportation and the desired position of the receptacle 41 within the outer box 1 is preserved as the present invention further comprises a first elongated tab 43 and a first bumper 47, shown in FIG. 3, FIG. 4, FIG. 5, and FIG. 6. The first elongated tab 43 reinforces the structure of the first brace 17 about the receptacle 41 as well as supports the receptacle 41 against main base plate 14. Similar to the first stabilizing arm 22 and the second stabilizing arm 23, the first bumper 47 prevents the receptacle 41 from sliding. The first bumper 47 also absorbs the impact of any exterior force against outer box 1 in order to further protect the receptacle 41. The first bumper 47 preferably comprises a first plate 48 and a second plate 49. The first plate 48 positions the second plate 49 against the receptacle 41 and absorbs any impact against the outer box 1. The second plate 49 presses against the receptacle 41, further reinforcing the desired position of the receptacle 41 within the first brace 17. The first brace 17 is hingedly connected to the main base plate 14, along a first end 26 of the first brace 17. A second end 27 of the first brace 17 is positioned opposite the first end 26 of the first brace 17, across the first brace 17. The first brace 17 is supported with both the first elongated tab 43 and the first bumper 47 as the first plate 48 is terminally fixed with the second plate 49, and the second plate 49 is connected to the main plate, opposite the first plate 48. Moreover, the first plate 48 is connected to the first brace 17, adjacent the first end 26 of the first brace 17. The second plate 49 is positioned offset the first end 26 of the first brace 17 with the first plate 48. The receptacle 41 is supported against the main base plate 14, beneath the first brace 17, as a first lateral edge 45 of the first elongated tab 43 traverses across and is hingedly connected to the second end 27 of the first brace 17. A second lateral edge 46 of the first elongated tab 43 is positioned adjacent the second plate 49, further preserving the structural integrity of the first brace 17.

The second brace 28 does not buckle throughout transportation and the desired position of the receptacle 41 within the outer box 1 is preserved as the present invention further comprises a second elongated tab 44 and a second bumper 50, also shown in FIG. 3, FIG. 4, FIG. 5, and FIG. 6. The second elongated tab 44 reinforces the structure of the second brace 28 about the receptacle 41 as well as supports the receptacle 41 against main base plate 14. Similar to the first stabilizing arm 22 and the second stabilizing arm 23, the second bumper 50 prevents the receptacle 41 from sliding. The second bumper 50 also absorbs the impact of any exterior force against outer box 1 in order to further protect the receptacle 41. The second bumper 50 preferably comprises a third plate 51 and a fourth plate 52. The third plate 51 positions the fourth plate 52 against the receptacle 41 and absorbs any impact against the outer box 1. The fourth plate 52 presses against the receptacle 41, further reinforcing the desired position of the receptacle 41 within the second brace 28. The second brace 28 is hingedly connected to the main base plate 14, along a first end 35 of the second brace 28. A second end 36 of the second brace 28 is positioned opposite the first end 35 of the second brace 28, across the second brace 28. The second brace 28 is supported with both the second elongated tab 44 and the second bumper 50 as the third plate 51 is terminally fixed with the fourth plate 52, and the fourth plate 52 is connected to the main plate, opposite the third plate 51. Moreover, the third plate 51 is connected to the second brace 28, adjacent the first end 35 of the second brace 28. The fourth plate 52 is positioned offset the first end 35 of the second brace 28 with the third plate 51. The receptacle 41 is supported against the main base plate 14, beneath the second brace 28, as a first lateral edge 45 of the second elongated tab 44 traverses across and is hingedly connected to the second end 36 of the second brace 28. A second lateral edge 46 of the second elongated tab 44 is positioned adjacent the fourth plate 52 further preserves the structural integrity of the second brace 28.

The first brace 17 and the second brace 28 are secured to each other in order for the receptacle 41 and the plant within the receptacle 41 remain safely housed within the stabilizing frame 13 while being separated from the outer box 1, seen in FIG. 4 and FIG. 5. The first brace 17 and the second brace 28 surround the receptacle 41 as the first lateral wall 18 is positioned opposite the second lateral wall 29 across the main base plate 14. The first lateral wall 18 and the second lateral wall 29 is hingedly connected to the main base plate 14, allowing the receptacle 41 to be easily positioned within the central slot 37. In order for the first brace 17 and the second brace 28 to grip the receptacle 41 within the central slot 37, the first stabilizing arm 22 is positioned adjacent and is removably attached with the third stabilizing arm 33. Similarly, the second stabilizing arm 23 is positioned adjacent and is removably attached with the fourth stabilizing arm 34.

In order for the first brace 17 and the second brace 28 to be removably attached to each other, the preferred embodiment of the present invention comprises at least one first push tab 53, at least one first tab-receiving slot 54, at least one second push tab 55, and at least one second tab-receiving slot 56. The at least one first push tab 53 and the at least one first tab-receiving slot 54 attaches the third stabilizing arm 33 with the first stabilizing arm 22, shown in FIG. 4 and FIG. 5. The at least one second push tab 55 and the at least one second tab-receiving slot 56 attaches the second stabilizing arm 23 with the fourth stabilizing arm 34, shown in FIG. 2 and FIG. 3. The at least one first push tab 53 is hingedly connected along a folding edge 24 of the third stabilizing arm 33. A first outer edge 25 of the first stabilizing arm 22 is positioned opposite the central slot 37 about the first stabilizing arm 22. The folding edge 24 is positioned offset with the first outer edge 25 of the third stabilizing arm 33. The at least one first tab-receiving slot 54 traverses through the first stabilizing arm 22, positioned adjacent the first outer edge 25 of the first stabilizing arm 22. The first outer edge 25 of the third stabilizing arm 33 is positioned opposite the central slot 37 about the third stabilizing arm 33. The at least one first push tab 53 is being operatively coupled with the at least one first tab-receiving slot 54, wherein the first stabilizing arm 22 is removably attached with the first stabilizing arm 22 with the at least one first push tab 53 and the at least one first tab-receiving slot 54. In order to attach the third stabilizing arm 33 to the first stabilizing arm 22, the user simply folds the at least one first push tab 53 through the at least one first tab-receiving slot 54 such that the at least one first push tab 53 is pressed against the first stabilizing arm 22. In order to separate the third stabilizing arm 33 from the first stabilizing arm 22, the user removes the at least one first push tab 53 from the at least one first tab-receiving slot 54.

Similarly, the at least one second push tab 55 is hingedly connected along a folding edge 24 of the second stabilizing arm 23. A first outer edge 25 of the second stabilizing arm 23 is positioned opposite the central slot 37 about the second stabilizing arm 23, also seen in FIG. 2 and FIG. 3. The folding edge 24 is positioned offset with the first outer edge 25 of the second stabilizing arm 23. The at least one second tab-receiving slot 56 traverses through the fourth stabilizing arm 34, positioned adjacent the first outer edge 25 of the fourth stabilizing arm 34. The first outer edge 25 of the fourth stabilizing arm 34 is positioned opposite the central slot 37 about the second stabilizing arm 23. The at least one second push tab 55 is being operatively coupled with the at least one second tab-receiving slot 56, wherein the second stabilizing arm 23 is removably attached with the fourth stabilizing arm 34 with the at least one second push tab 55 and the at least one second tab-receiving slot 56. In order to attach the second stabilizing arm 23 to the fourth stabilizing arm 34, the user simply folds the at least one second push tab 55 through the at least one second tab-receiving slot 56 such that the at least one second push tab 55 is pressed against the fourth stabilizing arm 34. In order to separate the second stabilizing arm 23 from the fourth stabilizing arm 34, the user removes the at least one second push tab 55 from the at least one second tab-receiving slot 56.

In the preferred embodiment of the present invention, the at least one first push tab 53 and the at least one second push tab 55 are positioned opposite each other about a lateral plane of the stabilizing frame 13. This arrangement further stabilizes the connection between the first brace 17 and the second brace 28. Furthermore, in the preferred embodiment of the present invention, the at least one first push tab 53 and the at least one first tab-receiving slot 54 is a couple of first push tabs and a couple of first tab-receiving slots distributed along the third stabilizing arm 33 and the first stabilizing arm 22, respectively, shown in FIG. 4 and FIG. 5. Similarly, in the preferred embodiment of the present invention seen in FIG. 3, the at least one second push tab 55 and the at least one second tab-receiving slot 56 is a couple of second push tabs and a couple of second tab-receiving slots distributed along the second stabilizing arm 23 and the fourth stabilizing arm 34, respectively.

In order to facilitate the removal of the stabilizing frame 13, the receptacle 41, and the plant within the receptacle 41 from within the outer box 1 and through the main opening 3 of the outer box 1, the present invention preferably comprise a plurality of first finger-receiving holes 57 and a plurality of second finger-receiving holes 58, seen in FIG. 3. The plurality of first finger-receiving holes 57 and the plurality of second finger-receiving holes 58 allows a user to have a sturdy and direct grip with the stabilizing frame 13.

The removal of the stabilizing frame 13, and consequently the receptacle 41, from within the outer box 1 is balanced as the plurality of first finger-receiving holes 57 is positioned opposite the main base plate 14 across the first brace 17. Moreover, the plurality of first finger-receiving holes 57 traverses into the first brace 17. Similarly, the plurality of second finger-receiving holes 58 is positioned opposite the main base plate 14, across the second brace 28. Moreover, the plurality of second finger-receiving holes 58 traverses into the second brace 28.

Shown in FIG. 1, FIG. 2, FIG. 3, FIG. 4, and FIG. 5, the present invention further comprises a first handle 59 and a second handle 60 that allows a user to remove the stabilizing frame 13 from within the outer box 1 if direct access to with the plurality of first finger-receiving holes 57 and the plurality of second finger-receiving holes 58 is inhibited by a plant housed by the receptacle 41. The first handle 59 and the second handle 60 are preferably flexible straps that evenly distribute the weight of the stabilizing frame 13, the receptacle 41, and the plant across the first brace 17 and the second brace 28, respectively. The first handle 59 is positioned opposite the main base plate 14 across the first brace 17 and is mounted onto the first brace 17. Similarly, the second handle 60 is positioned opposite the main base plate 14 across the second brace 28 and is mounted onto the second brace 28.

In order for a plant housed within the receptacle 41 to freely extend within the outer box 1, the stopper frame 8 must structurally reinforce the space between the stabilizing frame 13 and the fourth rim 2 of the outer box 1. In order for the stopper frame 8 to reinforce the outer box 1 and allow the plant to extend within the outer box 1 uninhibited, the stopper frame 8 comprise a first lateral wall 9, a second lateral wall 10, a third lateral wall 11, and a fourth lateral wall 12, shown in FIG. 2. The first lateral wall 9 is fixed adjacent the second lateral wall 10 and is oriented perpendicular with the second lateral wall 10. The third lateral wall 11 is fixed adjacent the second lateral wall 10, opposite the first lateral wall 9. The second lateral wall 10 is oriented perpendicular with the third lateral wall 11. The fourth lateral wall 12 is fixed adjacent the third lateral wall 11, opposite the second lateral wall 10. The third lateral wall 11 is oriented perpendicular with the fourth lateral wall 12. The first lateral wall 9 is fixed adjacent the fourth lateral wall 12, opposite the third lateral wall 11. The fourth lateral wall 12 is oriented perpendicular with the first lateral wall 9. This arrangement allows the stopper frame 8 to push the stabilizing frame 13 against the base 4 of the outer box 1 and reinforces the portion of the outer box 1 that surround the plant.

The outer box 1 fully encloses and shields the stabilizing frame 13, the stopper frame 8, and the receptacle 41 as the outer box 1 further comprises a first flap 6 and a second flap 7, seen in FIG. 1, FIG. 2, and FIG. 6. The lateral wall 5 is perimetrically fixed across the base 4 and is positioned adjacent the base 4. The first flap 6 and the second flap 7 are positioned adjacent the lateral wall 5, opposite the base 4, thereby sealing the main opening 3 of the outer box 1. Moreover, the first flap 6 and the second flap 7 are hingedly connected to the fourth rim 2 of the outer box 1. A user may secure the first flap 6 and the second flap 7 with each other with an adhesive fastener or a variety of other fasteners. The first flap 6 is positioned opposite the second flap 7 across the fourth rim 2, thereby fully covering the main opening 3.

An alternate embodiment of the present invention, shown in FIG. 6, comprises a removable compartment 61 that may further utilize the space between the stabilizing frame 13 and the fourth rim 2 of the outer box 1. The removable compartment 61 contains a variety of items that may compliment a plant housed within the receptacle 41 such as candy, chocolates, and so on. The removable compartment 61 is positioned within the outer box 1 and is positioned in between the stopper frame 8 and the fourth rim 2 of the outer box 1. Moreover, the removable compartment 61 is positioned offset from the stabilizing frame 13 with the stopper frame 8.

Although the invention has been explained in relation to its preferred embodiment, it is to be understood that many other possible modifications and variations can be made without departing from the spirit and scope of the invention as hereinafter claimed.

What is claimed is:

1. A modular potted plant shipping box comprises:
- an outer box;
- a stopper frame;
- a stabilizing frame;
- a receptacle;
- the stabilizing frame comprise a main base plate, a first brace, a second brace, and a central slot;
- the stabilizing frame, the stopper frame, and the receptacle being positioned within the outer box;
- a first edge of the main base plate being positioned opposite a second edge of the main base plate, across the main base plate;
- the first brace being hingedly connected to the main base plate along the first edge of the main base plate;
- the second brace being hingedly connected to the main base plate along the second edge of the main base plate;
- the central slot traversing through the first brace and the second brace;
- the central slot oriented perpendicular with the main plate;
- the receptacle being positioned within the central slot, between the first brace and the second brace;
- the receptacle being positioned within and frictionally engaged with a main rim of the central slot;
- a fourth rim of the outer box being positioned opposite a base of the outer box across a lateral wall of the outer box;
- a main opening of the outer box being defined by the fourth rim; and,
- the stopper frame being positioned in between the stabilizing frame and the fourth rim.

2. The modular potted plant shipping box as claimed in claim 1 comprises:
- a second rim of the stopper frame being positioned opposite a third rim of the stopper frame, across the stabilizing frame;
- the second rim being positioned adjacent the main rim of the central slot;
- the third rim being positioned adjacent the fourth rim of the outer box; and,
- a first rim of the receptacle being oriented parallel with the second rim, the third rim, and the fourth rim.

3. The modular potted plant shipping box as claimed in claim 1 comprises:
- the first brace comprises a first lateral wall, a first cover plate, a first stabilizing arm, and a second stabilizing arm;
- the first lateral wall being hingedly connected along the first edge of the main base plate;
- the first cover plate being positioned adjacent along a first edge of the first lateral wall, opposite the main base plate;

the first cover plate being hingedly connected along the first edge of the first lateral wall;

the first stabilizing arm and the second stabilizing arm being positioned adjacent a first edge of the first cover plate, opposite the first lateral wall;

the first stabilizing arm being positioned opposite the second stabilizing arm across the first edge of the first cover plate; and, the first cover plate being offset from the main base plate with the first lateral wall, the first stabilizing arm, and the second stabilizing arm.

4. The modular potted plant shipping box as claimed in claim 3 comprises:

the first stabilizing arm and the second stabilizing arm being removably coupled to the second brace.

5. The modular potted plant shipping box as claimed in claim 3 comprises:

the receptacle being positioned between and frictionally engaged with the first stabilizing arm and the second stabilizing arm.

6. The modular potted plant shipping box as claimed in claim 1 comprises:

the second brace comprises a second lateral wall, a second cover plate, a third stabilizing arm, and a fourth stabilizing arm;

the second lateral wall being hingedly connected along the second edge of the main base plate;

the second cover plate being positioned adjacent along a first edge of the second lateral wall, opposite the main base plate;

the second cover plate being hingedly connected along the first edge of the second lateral wall;

the third stabilizing arm and the fourth stabilizing arm being positioned adjacent a first edge of second cover plate, opposite the second lateral wall;

the third stabilizing arm being positioned opposite the fourth stabilizing arm across the first edge of the second cover plate; and, the second cover plate being offset from the main base plate with the second lateral wall, the third stabilizing arm, and the fourth stabilizing arm.

7. The modular potted plant shipping box as claimed in claim 6 comprises:

the third stabilizing arm and the fourth stabilizing arm being removably coupled to the first brace.

8. The modular potted plant shipping box as claimed in claim 6 comprises:

the receptacle being positioned between and frictionally engaged with the third stabilizing arm and the fourth stabilizing arm.

9. The modular potted plant shipping box as claimed in claim 1 comprises:

a first elongated tab;

a first bumper;

the first bumper comprises a first plate and a second plate;

the first brace being hingedly connected to the main plate, along a first end of the first brace;

a second end of the first brace being positioned opposite the first end of the brace across the first brace;

the first plate being terminally fixed with the second plate;

the second plate being connected to the main plate, opposite the first plate;

the first plate being connected to the first brace, adjacent the first end of the first brace;

the second plate being positioned offset the first end of the first brace with the first plate;

a first lateral edge of the first elongated tab traversing across and being hingedly connected to the second end of the first brace; and, a second lateral edge of the first elongated tab being positioned adjacent the second plate.

10. The modular potted plant shipping box as claimed in claim 1 comprises:

a second elongated tab;

a second bumper;

the second bumper comprises a third plate and a fourth plate;

the second brace being hingedly connected to the main plate, along a first end of the second brace;

a second end of the second brace being positioned opposite the first end of the second brace, across the second brace;

the third plate being terminally fixed with the fourth plate;

the fourth plate being connected to the main plate, opposite the third plate;

the third plate being connected to the second brace, adjacent the first end of the second brace;

the fourth plate being positioned offset the first end of the second brace with the third plate;

a first lateral edge of the second elongated tab traversing across and being hingedly connected to the second end of the second brace; and, a second lateral edge of the second elongated tab being positioned adjacent the fourth plate.

11. The modular potted plant shipping box as claimed in claim 1 comprises:

the first brace comprises a first lateral wall, a first cover plate, a first stabilizing arm, and a second stabilizing arm;

the second brace comprises a second lateral wall, a second cover plate, a third stabilizing arm, and a fourth stabilizing arm;

the first lateral wall being positioned opposite the second lateral wall across the main base plate;

the first lateral wall and the second lateral wall being hingedly connected to the main base plate;

the first stabilizing arm and the second stabilizing arm being positioned adjacent the first cover plate, opposite the first lateral wall;

the first cover plate being hingedly connected to the first stabilizing arm, the second stabilizing arm, and the first lateral wall;

the third stabilizing arm and the fourth stabilizing arm being positioned adjacent the second cover plate, opposite the second lateral wall;

the second cover plate being hingedly connected to the third stabilizing arm, the fourth stabilizing arm, and the second lateral wall;

the first stabilizing arm being positioned adjacent and removably attached with the third stabilizing arm; and, the second stabilizing arm being positioned adjacent and removably attached with the fourth stabilizing arm.

12. The modular potted plant shipping box as claimed in claim 11 comprises:

at least one first push tab;

at least one first tab-receiving slot;

the at least one first push tab being hingedly connected along a folding edge of the third stabilizing arm;

a first outer edge of the first stabilizing arm being positioned opposite the central slot about the first stabilizing arm;

the folding edge being positioned offset with the first outer edge of the third stabilizing arm;

the at least one first tab-receiving slot traversing through the first stabilizing arm, positioned adjacent the first outer edge of the first stabilizing arm;

the first outer edge of the third stabilizing arm being positioned opposite the central slot about the third stabilizing arm; and, the at least one first push tab being operatively coupled with the at least one first tab-receiving slot, wherein the first stabilizing arm is removably attached with the first stabilizing arm with the at least one first push tab and the at least one first tab-receiving slot.

13. The modular potted plant shipping box as claimed in claim 11 comprises:

at least one second push tab;

at least one second tab-receiving slot;

the at least one second push tab being hingedly connected along a folding edge of the second stabilizing arm;

a first outer edge of the second stabilizing arm being positioned opposite the central slot about the second stabilizing arm;

the folding edge being positioned offset with the first outer edge of the second stabilizing arm;

the at least one second tab-receiving slot traversing through the fourth stabilizing arm, positioned adjacent a first outer edge of the fourth stabilizing arm;

the first outer edge of the fourth stabilizing arm being positioned opposite the central slot about the fourth stabilizing arm; and, the at least one second push tab being operatively coupled with the at least one second tab-receiving slot, wherein the second stabilizing arm is removably attached with the fourth stabilizing arm with the at least one second push tab and the at least one second tab-receiving slot.

14. The modular potted plant shipping box as claimed in claim 1 comprises:

a plurality of first finger-receiving holes;

a plurality of second finger-receiving holes;

the plurality of first finger-receiving holes being positioned opposite the main base plate across the first brace;

the plurality of first finger-receiving holes traversing into the first brace;

the plurality of second finger-receiving holes being positioned opposite the main base plate across the second brace; and, the plurality of second finger-receiving holes traversing into the second brace.

15. The modular potted plant shipping box as claimed in claim 1 comprises:

a first handle;

a second handle;

the first handle being positioned opposite the main base plate across the first brace;

the first handle being mounted onto the first brace;

the second handle being positioned opposite the main base plate across the second brace; and, the second handle being mounted onto the second brace.

16. The modular potted plant shipping box as claimed in claim 1 comprises:

the stopper frame comprises a first lateral wall, a second lateral wall, a third lateral wall, and a fourth lateral wall;

the first lateral wall being fixed adjacent the second lateral wall;

the first lateral wall being oriented perpendicular with the second lateral wall;

the third lateral wall being fixed adjacent the second lateral wall, opposite the first lateral wall;

the second lateral wall being oriented perpendicular with the third lateral wall;

the fourth lateral wall being fixed adjacent the third lateral wall, opposite the second lateral wall;

the third lateral wall being oriented perpendicular with the fourth lateral wall;

the first lateral wall being fixed adjacent the fourth lateral wall, opposite the third lateral wall; and, the fourth lateral wall being oriented perpendicular with the first lateral wall.

17. The modular potted plant shipping box as claimed in claim 1 comprises:

the outer box comprises a first flap and a second flap;

the lateral wall being perimetrically fixed across the base;

the lateral wall being positioned adjacent the base;

the first flap and the second flap being positioned adjacent the lateral wall, opposite the base;

the first flap and the second flap being hingedly connected to the fourth rim of the outer box; and, the first flap being positioned opposite the second flap across the fourth rim.

18. The modular potted plant shipping box as claimed in claim 1 comprises:

a removable compartment;

the removable compartment being positioned within the outer box;

the removeable compartment being positioned between the stopper frame and the fourth rim of the outer box; and, the removeable compartment being positioned offset from the stabilizing frame with the stopper frame.

* * * * *